US009631324B2

(12) United States Patent
Jalayer et al.

(10) Patent No.: US 9,631,324 B2
(45) Date of Patent: Apr. 25, 2017

(54) V-TRACK SUPPORT STRUCTURE COMPONENT

(71) Applicant: DYNAMIC STRUCTURES, LTD., Port Coquitlam (CA)

(72) Inventors: Mehdi Jalayer, North Vancouver (CA); Nathan Loewen, Vancouver (CA)

(73) Assignee: Dynamic Structures, Ltd., Port Coquitlam, British Columbia (CA)

( * ) Notice: Subject to any disclaimer, the term of this patent is extended or adjusted under 35 U.S.C. 154(b) by 0 days.

(21) Appl. No.: 14/990,958

(22) Filed: Jan. 8, 2016

(65) Prior Publication Data

US 2016/0222593 A1 Aug. 4, 2016

Related U.S. Application Data

(60) Provisional application No. 62/101,729, filed on Jan. 9, 2015.

(51) Int. Cl.

| | |
|---|---|
| ***E01B 25/00*** | (2006.01) |
| ***A63G 7/00*** | (2006.01) |
| ***E01B 23/02*** | (2006.01) |

(52) U.S. Cl.

CPC ..... *E01B 25/00* (2013.01); *A63G 7/00* (2013.01); *E01B 23/02* (2013.01)

(58) Field of Classification Search

CPC ..... E01B 25/00; E01B 25/02; E01B 25/08; E01B 25/10; E01B 25/28; E01B 26/00

See application file for complete search history.

(56) References Cited

U.S. PATENT DOCUMENTS

| | | | | |
|---|---|---|---|---|
| 218,895 A * | 8/1879 | Osborne | E01B 25/305 | 104/124 |
| 354,558 A * | 12/1886 | Latimer | E01B 25/305 | 104/124 |
| 5,027,713 A * | 7/1991 | Kindmann | E01B 25/305 | 104/124 |
| 5,511,488 A * | 4/1996 | Powell | B60L 13/06 | 104/124 |
| 5,823,114 A * | 10/1998 | Cioletti | E01B 25/305 | 104/124 |
| 6,279,484 B1 * | 8/2001 | Shaw | E01B 25/12 | 104/130.01 |

(Continued)

FOREIGN PATENT DOCUMENTS

| | | |
|---|---|---|
| GB | 1495143 | 12/1977 |
| WO | 2007062646 | 6/2007 |

OTHER PUBLICATIONS

International Search Report for PCT/CA2016/050011 dated Mar. 1, 2016.

Written Opinion for PCT/CA2016/050011 dated Mar. 7, 2016.

*Primary Examiner* — Jason C Smith

(74) *Attorney, Agent, or Firm* — Gottlieb, Rackman & Reisman, P.C.

(57) ABSTRACT

A track structure component that includes a triangular girder having a top plate, a first side plate and a second side plate with a lower surface of the top plate abutting the first edge of the first side plate, the lower surface of the top plate abutting the first edge of the second side plate and the second side edge of the first side plate abutting the second side edge of the second side plate and a rail component that includes at least one rail positioned adjacent to an upper surface of the top plate.

14 Claims, 5 Drawing Sheets

(56) References Cited

U.S. PATENT DOCUMENTS

| | | | | |
|---|---|---|---|---|
| 6,782,832 | B2 * | 8/2004 | Reichel | B60L 13/00 104/124 |
| 6,785,945 | B2 * | 9/2004 | Reichel | E01B 25/32 104/120 |
| 6,796,246 | B1 * | 9/2004 | Atzpodien | E01B 25/30 104/281 |
| 7,699,006 | B2 * | 4/2010 | Miller | E01B 25/32 104/259 |
| 7,699,007 | B2 * | 4/2010 | Miller | E01B 25/32 104/259 |
| 8,061,494 | B2 * | 11/2011 | Rameau | B60M 1/307 104/124 |
| 8,066,200 | B2 * | 11/2011 | Hepner | E01B 25/08 104/118 |
| 8,297,017 | B2 * | 10/2012 | Platt | E04B 5/04 14/6 |
| 8,312,678 | B1 * | 11/2012 | Haddock | E04D 12/004 52/101 |
| 8,342,101 | B2 * | 1/2013 | Kissel | B61B 13/04 104/119 |
| 9,096,235 | B2 * | 8/2015 | Kissel | B61B 5/02 |
| 9,096,236 | B2 * | 8/2015 | Kissel, Jr. | B61C 13/04 |
| 2003/0101896 | A1 * | 6/2003 | Cummins | B61B 13/00 104/156 |
| 2003/0183117 | A1 * | 10/2003 | Morris | B60M 5/00 104/2 |
| 2012/0137923 | A1 * | 6/2012 | Hepner | B61B 13/02 105/141 |

* cited by examiner

V-TRACK SUPPORT STRUCTURE COMPONENT

CROSS-REFERENCE TO RELATED APPLICATIONS

This application is a continuation application of U.S. Provisional Patent Application No. 62/101,729 filed on Jan. 9, 2015. The forgoing application is incorporated by reference herein in its entirety.

FIELD OF THE INVENTION

The present invention relates to a V-track support structure for a vehicle track. More specifically, the present invention relates to a modular support structure for use in connection with a vehicle track on an amusement ride.

BACKGROUND OF THE INVENTION

Tracked vehicles are quite common in a wide variety of applications, from public transit vehicles, to factory floor robots to amusement park rides. Tracked vehicle systems can provide easily automated, safe and energy efficient solutions for moving people, livestock or goods over a variety of terrains and have relatively rapid installation times.

In all of these applications, a vehicle can ride on provided rail(s) which must be able to easily support the weight of the vehicle without undue flexing while being able to absorb the static and dynamic loads that can occur as the vehicle rolls over the rails. Accordingly, the rails can be laid directly on the ground, such as in the case of a traditional railroad track, or can be mounted to an underlying support structure that is designed to withstand the significant engineering challenges that are presented when a heavy vehicle rolls on rails.

In the case where rails are laid on an underlying support structure, it will be readily appreciated that it is preferable if the underlying support structure can be constructed of a series of modular components that can withstand the dynamic and static loads to which the system is exposed in the particular end user application.

Moreover, in the context of amusement ride applications, it will be readily appreciated that a support structure component that is relatively lightweight yet torsionally stiff and resistant to bending moments and fatigue will permit ride designers more options and flexibility in terms of the forces that can be applied to the passenger cart and the shape of track that can be safely constructed resulting in a more exciting and vibrant ride experience.

Presently available box and tube-shaped backbone structures can be prone to flexing, thereby introducing a relatively large degree of vertical eccentricity between the central axis of the backbone structure and the supported rails. This vertical eccentricity stresses both the rails and connecting components which can shorten the working life of the system and increase maintenance costs.

Finally, in all applications, it is desirable that the support structure component having the requisite physical properties can be manufactured in an economical manner using fewer components and requiring fewer welds than available prior art solutions, such as box and tube-shaped backbone structures.

Accordingly, there is need for a track structure that is modular, economical to manufacture, relatively lightweight, torsionally stiff, resistant to bending moments and fatigue and easy to install in a wide variety of applications.

SUMMARY OF THE INVENTION

The present invention provides a track structure component that can be modular, economical to manufacture, torsionally stiff, resistant to bending moments and fatigue and easy to install in a wide variety of applications.

In at least one embodiment, the present invention provides a track structure support component having a triangular girder, the triangular girder having a top plate longitudinally extending between a first end and a second end and having a longitudinally extending first edge, a longitudinally extending second edge, a longitudinally extending upper surface and a longitudinally extending lower surface, a first side plate longitudinally extending between a first end and a second end having a longitudinally extending first edge and a longitudinally extending second edge, and a second side plate longitudinally extending between a first end and a second end and having a longitudinally extending first edge and a longitudinally extending second edge wherein the lower surface of the top plate abuts the first edge of the first side plate and the first edge of the second side plate and the second side edge of the first side plate abuts the second side edge of the second side plate to form the triangular girder, and a rail component, the rail component having at least one rail longitudinally extending between a first end and a second end and positioned adjacent to the upper surface of the top plate.

BRIEF DESCRIPTION OF THE FIGURES

The present invention will be better understood in connection with the following Figures, in which.

DETAILED DESCRIPTION OF EMBODIMENTS OF THE INVENTION

Figure 1:
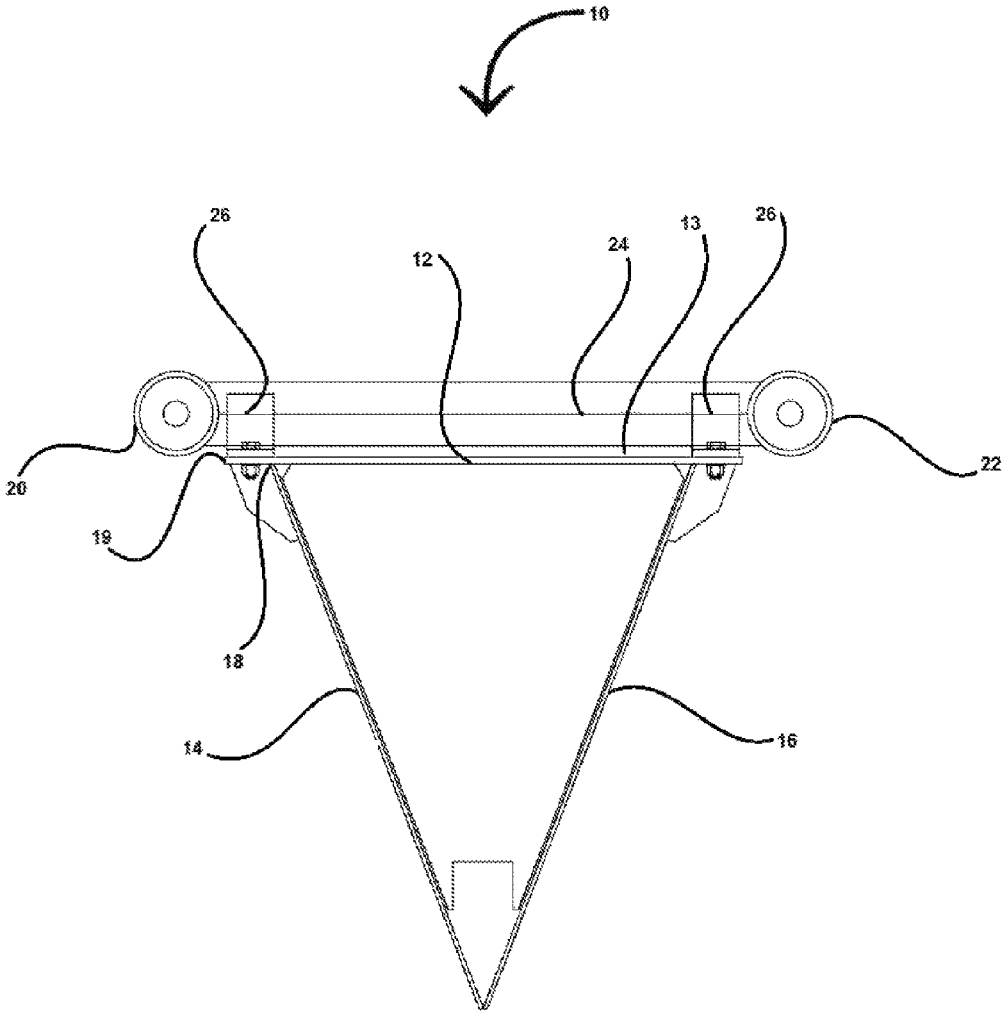
FIG. 1 is an end view of a track support structure component in accordance with at least one embodiment of the present invention.

The present invention provides a track support structure component that can be modular, economical to manufacture, torsionally stiff, resistant to bending moments and fatigue and easy to install in a wide variety of applications.

It will be readily understood that all of the components discussed herein can be manufactured by any suitable process and of any suitable material that will be readily understood by the skilled person. It will be further understood that the present invention can be produced in any suitable dimensions as required by a particular end user application.

It will be readily understood that all components described herein can have any surface finish as required by the end-user application. Further, it will be readily appreciated that all components described herein can be finished with radial corners and edges, orthogonal corners and edges, singly or multiply beveled corners and edges, among any other arrangements required by the chosen manufacturing process and end user application, as will be readily understood by the skilled person. Analogously and as discussed below, all bores, cutouts and slots discussed herein can optionally be threaded or countersunk as required.

All components discussed herein can be formed of separate components suitably joined together by any suitable process (such as welding or mechanical fastening) or alternatively can be formed of a single, unitary component.

The present invention can provide a track support structure component that includes a triangular backbone structure in the form of a triangular girder having a top plate having an upper surface, a first side plate and a second side plate. A rail component having at least one rail is provided adjacent to the upper surface of the top plate for receiving a tracked vehicle.

In some embodiments it is contemplated that the triangular girder is composed of three separate longitudinal plate elements suitably joined together or alternatively can be formed of a single, unitary element that is manufactured by a suitable process (such as, but not limited to, extrusion or cold forming) to provide the requisite shape.

It is contemplated that in some embodiments, the present track structure component will be generally straight, while in other embodiments, the present track structure component will be generally curved, as required by the end user application. In this way, multiple track structure components can be linked together to form a track system of any shape, as will be discussed in further detail below. In some embodiments the track structure component will be used to support a tracked vehicle in an upright manner while in other embodiments the track structure component may be used to suspend a tracked vehicle in an upside down manner or sideways manner, among other arrangements that will be readily appreciated by the skilled person.

It is contemplated that the present track structure component can be delivered to the jobsite fully assembled or alternatively, it is contemplated that the constituent components can be delivered to the jobsite unassembled (or partially assembled) and assembled in situ.

It is contemplated that the at least one rail can have any suitable cross-sectional shape, including but not limited to, square, circular, elliptical, semi-circular, semi-elliptical, grooved, among any other type of known rail shape as required by the end user application and that will be readily appreciated by the skilled person.

In at least one embodiment it is contemplated that the at least one rail is two rails and these two rails can have a series of laterally extending cross ties, each cross tie adjoining the first rail to the second rail. In some embodiments it is contemplated that the cross tie is directly affixed to an upper surface of the top plate of the triangular girder while in other embodiments it is contemplated that an L-bracket is placed between the cross tie and the upper surface of the top plate of the triangular girder to affix the cross tie to the upper surface of the triangular girder, among other arrangements that will be readily understood by the skilled person.

It is contemplated that the present track structure component can be mounted to a supporting surface (such as, but not limited to, a pillar or a concrete foundation) by way of a mounting stool. In at least one embodiment the mounting stool can consist of a laterally oriented stool web having an angular upper edge that abuts the lower surface of the triangular girder. The stool web can have a lower edge that abuts a mounting flange. In at least one embodiment, the mounting flange is oriented perpendicularly to the stool web, however other arrangements are also contemplated depending on the needs of the end user application.

It is contemplated that in some embodiments the stool web can further include at least one support plate having a proximal surface that abuts an outer edge of the stool web. The support plate has an upper edge that can abut a lower surface of the triangular girder and a lower edge that abuts an upper surface of the mounting flange.

It is further contemplated that the mounting stool can have at least one stiffening rib that abuts an outer surface of the support plate and extends between the upper surface of the mounting flange and at least the lower surface of the triangular girder. In some embodiments, it is contemplated that the stiffening rib extends upwardly to a lower surface of a top plate that forms the upper surface of the triangular girder, as will be discussed in further detail below.

It is further contemplated that multiple track structure components as described herein can be linked together to form a continuously supported track structure. In some embodiments, it is contemplated that at least one girder splice plate is located on an outer surface of one end of the triangular girder. Further, in some embodiments it is contemplated that at least one rail splice plate is located at one end on the at least one rail.

In this way, it is contemplated that a first vehicle track structure component can be linked to a second track structure component by way of girder splice plates and rail splice plates, as will be discussed in greater detail below.

Figure 2:
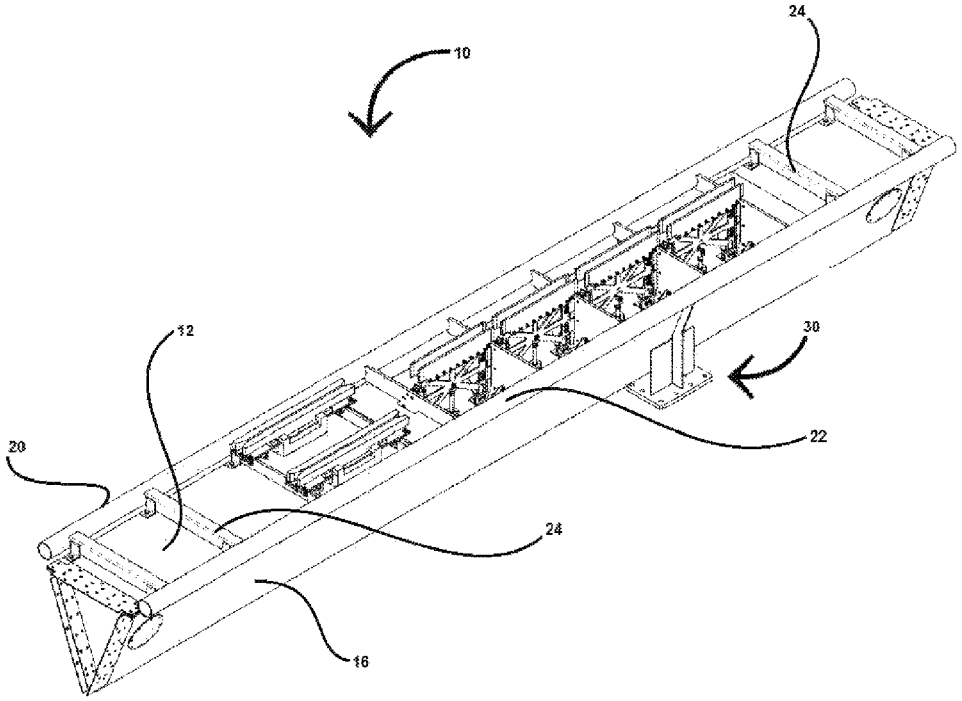
FIG. 2 is an isometric view of the track support structure component of FIG. 1.

Turning to FIGS. 1 and 2, at least one embodiment of the track structure component in accordance with the present invention is illustrated. Track structure component 10 has a triangular backbone structure that is a triangular girder having a longitudinally extending top plate 12, a longitudinally extending first side plate 14 and a longitudinally extending second side plate 16. Top plate 12 has an upper surface 13.

As can be seen in FIG. 1, it is contemplated that in at least one embodiment a first edge 18 of first side plate 14 abuts the lower surface of top plate 12 at a point located inwardly from the outer edge 19 of top plate 12, however it is also contemplated that first edge 18 of first side plate 14 abuts outer edge 19 of top plate 12. In an analogous way, a first edge of second side plate 16 can abut the lower surface of top plate at a position inward of the outer edge of top plate or, in other embodiments, directly at the outer edge of top plate. As will be understood by the skilled person, it is contemplate that in at least one embodiment the triangular girder is symmetrical about a central axis, as shown in FIGS. 1 and 3.

Figure 3:
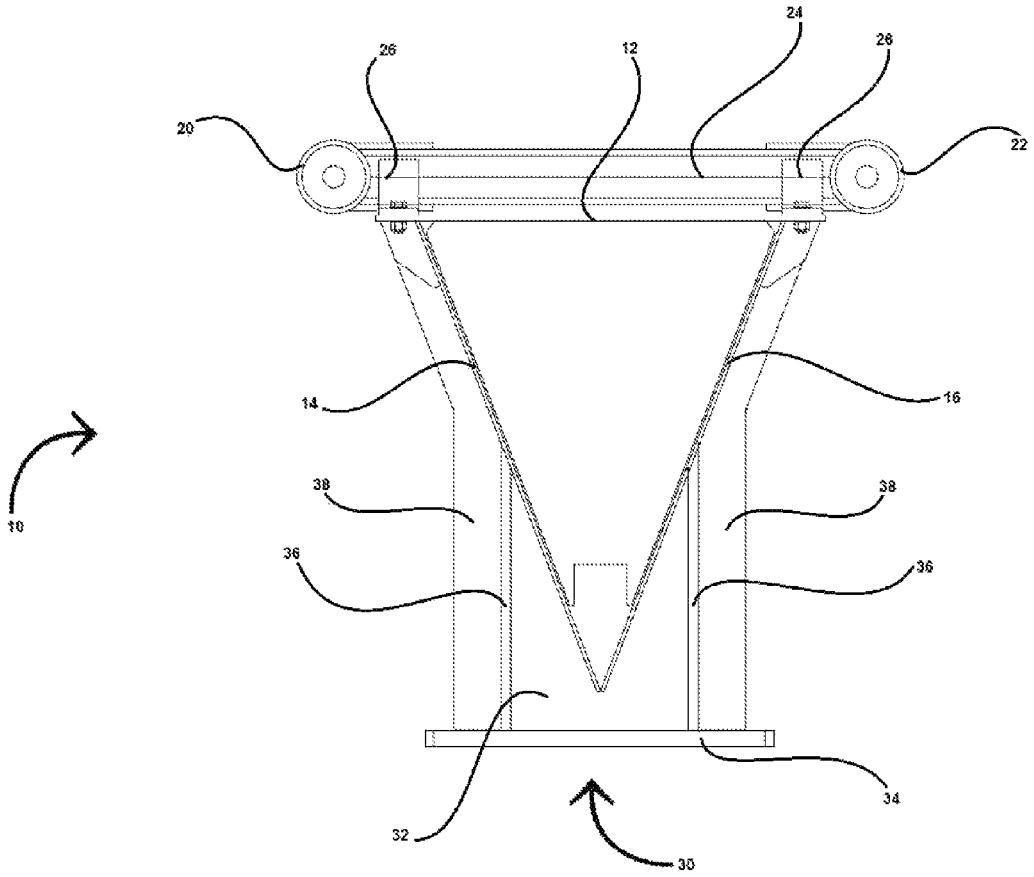
FIG. 3 is an end view of a track support structure component having a mounting stool in accordance with at least one embodiment of the present invention.

In at least one embodiment, the rail component has a first rail 20 connected to a second rail 22 by way of a cross tie 24, as seen in FIGS. 1, 2 and 3. In this embodiment, cross tie 24 is attached to upper surface 13 of the top plate 12 by way of at least one L-bracket 26 however other arrangements are also contemplated, such as where the cross tie 24 is attached directly to the upper surface of the top plate 12 without a bracket, among other arrangements that will be readily understood by the skilled person.

As can be seen in FIG. 2, a variety of optional tracked vehicle systems can be mounted on the top plate 12 of the triangular girder. Example of such optional tracked vehicle systems include but are not limited to chain or cable traction systems, braking systems, acceleration systems, linear motor systems, track-switching systems, among other optional tracked vehicle systems that will be readily understood by the skilled person.

Figure 4:
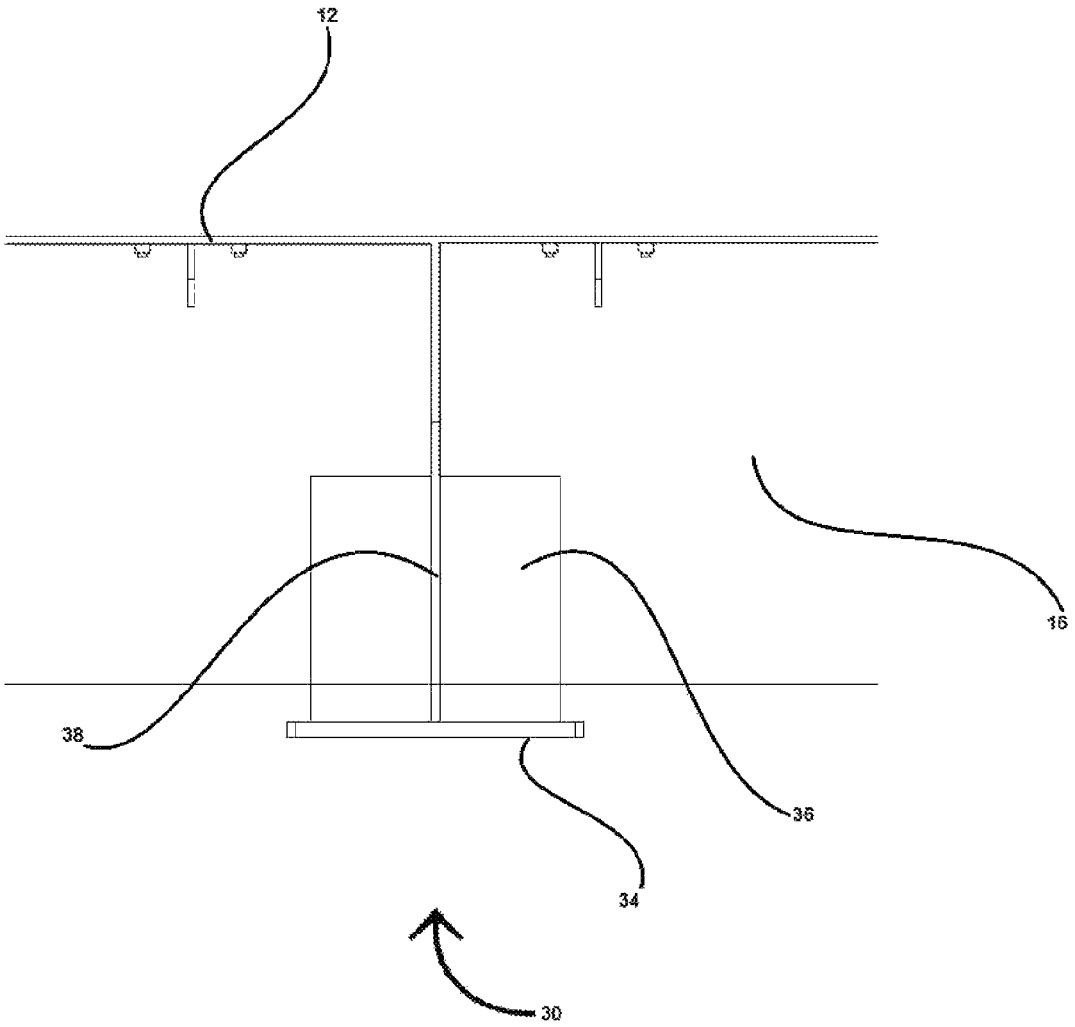
FIG. 4 is a side view of a mounting stool located on the track support structure in accordance with at least one embodiment of the present invention.
Figure 5:
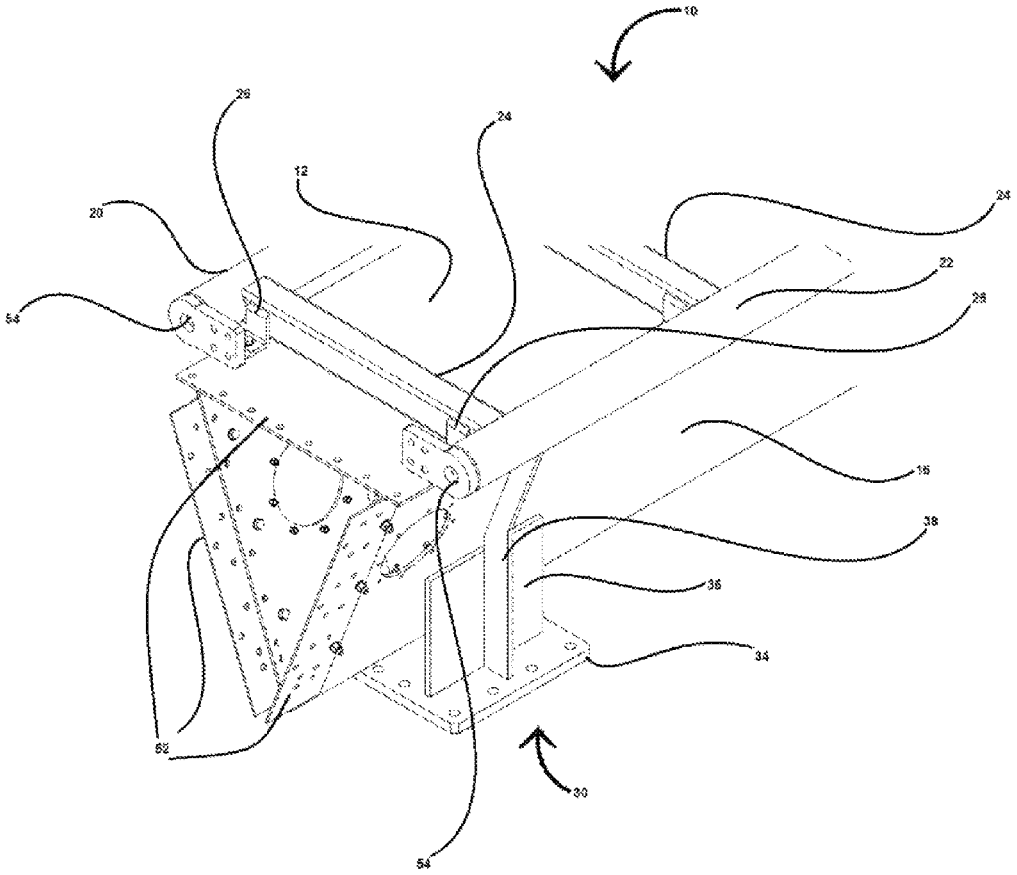
FIG. 5 is an isometric view of a track support structure component having a mounting stool and splice plates in accordance with at least one embodiment of the present invention.

Turning to FIGS. 3, 4 and 5 at least one embodiment of a mounting stool 30 for mounting the track structure component 10 to an underlying mounting structure component is illustrated. Mounting stool 30 can include a transversely oriented stool web 32 that has an upper edge that abuts the lower surface of the triangular girder (which in this embodiment, is the outer surfaces of first side plate 14 and second side plate 16). In at least one embodiment it is contemplated that upper edge is an angular upper edge, as seen in FIG. 3.

Stool web 32 also has a lower edge that abuts a mounting flange 34. It is contemplated that in some embodiments, stool web 32 is oriented perpendicularly to mounting flange 34 while in other embodiments these two components can be oriented non-perpendicularly to one another as required by the instant needs of the end user application.

In some embodiments mounting flange 34 will have a series of holes or bores for receiving a mechanical fastener in order to secure the mounting stool to the underlying support structure, which could be a pillar or concrete slab, among any other arrangements that will be readily appreciated by the skilled person. Further, mounting flange 34 can have any suitable shape as required by the end user application, including but not limited to square, circular and rectangular.

Mounting stool 30 can further include at least one support plate 36. Support plate 36 has a proximal surface that abuts an outer edge of stool web 32, an upper edge which abuts a lower surface of the triangular girder (which in this embodiment, is the outer surfaces of first side plate 14 and second side plate 16) and a lower edge which abuts mounting flange 34.

In some embodiments, it is further contemplated that mounting stool 30 can further comprise a stiffening rib 38 that has a proximal edge that abuts a distal surface of support plate 36, a lower edge that abuts an upper surface of mounting flange 34 and an upper edge that abuts at least one of the lower surface of the triangular girder (which in this embodiment, is the outer surfaces of first side plate 14 and second side plate 16) and the lower surface of the top plate 12, as seen in FIGS. 3 and 4.

As can be seen in FIG. 5, in some embodiments at least one of top plate 12, first side plate 14 or second side plate 16 can have a girder splice plate 52 located at one end of the plate. It is contemplated that in some embodiments girder splice plate 52 can have a series of holes so that it can be bolted or otherwise directly fastened to the triangular girder, or alternatively it is contemplated that girder splice plate can be formed integrally with the triangular girder, among other arrangements that will be readily understood by the skilled person.

It will therefore be readily understood that a first track structure component can be connected to a second track structure component by way of girder splice plate 52. Specifically, girder splice plate 52 can be mounted directly to one end of at least one of top plate 12, first side plate 14 or second side plate 16 of a first track structure component and to one end of at least one of top plate 12, first side plate 14 or second side plate 16 of a second track structure component to connect these two track structure components together.

Further, in some embodiments, rail 20, 22 can also have a rail splice plate 54 that is located at an end of rail 20, 22. It is further contemplated that rail splice plate 54 can have an outwardly projecting flange having a hole for receiving a mechanical fastener such as a bolt or a rivet. In this way a first rail splice of a first track structure component can abut and be connected to a second rail splice on a second track structure component to form one smoothly continuous rail.

In this way, multiple track structure components can be linked together to form a track system having a shape as required by the selected end-user application.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

What is claimed is:

1. A track structure support component comprising:

a triangular girder, the triangular girder including:

a top plate longitudinally extending between a first top plate end and a second top plate end and having a longitudinally extending first top plate edge, a longitudinally extending second top plate edge, a longitudinally extending top plate upper surface and a longitudinally extending top plate lower surface;

a first side plate longitudinally extending between a first side plate first end and a first side plate second end having a longitudinally extending first side plate first edge and a longitudinally extending first side plate second edge; and a second side plate longitudinally extending between a second side plate first end and a second side slate second end and having a longitudinally extending second side plate first edge and a longitudinally extending second side plate second edge;

wherein the top plate lower surface abuts the first side plate first edge and the second side plate first edge and the first side plate second edge abuts the second side plate second edge to form the triangular girder;

a rail component, the rail component including:

at least one rail longitudinally extending between a first rail end and a second rail end and positioned adjacent the top plate upper surface; and at least one mounting stool including a downwardly extending stool web and a mounting flange, the stool web having an upper edge abutting an outer surface of the first side plate and an outer surface of the second side plate, the stool web having a lower edge abutting an upper surface of the mounting flange.

2. The track structure support component of claim 1 wherein the rail component further comprises a first rail and a second rail.

3. The track structure support component of claim 2 further comprising at least one cross tie having a first cross tie end, the at least one cross tie abutting the upper surface of the top plate and laterally extending between the first rail and second rail.

4. The track structure support component of claim 3 wherein the at least one cross tie further comprises at least one L bracket, the at least one L bracket positioned between the at least one cross tie and the upper surface of the top plate.

5. The track structure support component of claim 1 wherein at least one of the first rail end of the at least one rail and the second rail end of the at least one rail includes a rail splice plate.

6. The track structure support component of claim 5 wherein the rail splice plate further comprises a radially projecting flange tab.

7. The track structure support component of claim 6 wherein the flange tab has at east one bore.

8. The track structure support component of claim 1 wherein at least one of the first end of the top plate, the second end of the top plate, the first end of the first side plate, the second end of the first side plate, the first end of the second side plate and the second end of the second side plate further has a girder splice plate.

9. The track structure support component of claim 8, wherein the girder splice plate has at least one bore.

10. The track structure support component of claim 1 wherein the stool web is orthogonally oriented to the mounting flange.

11. The track structure support component of claim 10 wherein the mounting stool further comprises at least one support plate having an upper edge that abuts one of the outer surface of the first side plate and the outer surface of the second side plate, the at least one support plate having a lower edge that abuts the upper surface of the mounting flange, the at least one support plate having a proximal surface that abuts an outer edge of the stool web.

12. The track structure support component of claim 11, wherein the at least one support plate further comprises a stiffening rib, the stiffening rib having a first rib end abutting at least one of the outer surface of the first plate, the outer surface of second plate and the lower surface of the top plate, the stiffening rib having a second rib end abutting the upper surface of the mounting flange, the stiffening rib having a proximal edge abutting a distal surface of the mounting flange.

13. The track structure support component of claim 1 wherein the mounting flange has at least one bore.

14. The track structure support component of claim 1 wherein at least one of the top plate, first side plate and the second side plate is perforated.

* * * * *